United States Patent [19]

Bartnicki

[11] Patent Number: 5,067,589

[45] Date of Patent: Nov. 26, 1991

[54] EXTENDABLE SUPPORT

[75] Inventor: Frederick J. Bartnicki, Greenville, Pa.

[73] Assignee: R. D. Werner Co., Inc., Greenville, Pa.

[21] Appl. No.: 560,378

[22] Filed: Jul. 31, 1990

[51] Int. Cl.[5] ..... E04G 5/08

[52] U.S. Cl. ..... 182/223; 182/119

[58] Field of Search ..... 182/223, 222, 119

[56] References Cited

U.S. PATENT DOCUMENTS

| | | | |
|---|---|---|---|
| 1,267,618 | 5/1918 | Andersen | 182/223 |
| 2,120,158 | 6/1938 | Starrick | 182/223 |
| 3,282,378 | 11/1966 | Pierce | 182/223 |
| 3,889,779 | 6/1975 | Kummerlin | 182/223 |
| 4,768,620 | 9/1988 | South | 182/223 |

*Primary Examiner*—Reinaldo P. Machado

*Attorney, Agent, or Firm*—Ansel M. Schwartz

[57] ABSTRACT

A support having two support sections slidably engaged with each other includes a lock that can be used to releasably fix the size of the support surface defined by the support sections. The lock is mounted to one of the support sections and includes a shaft that can be received by any of the series of openings defined by the remaining support section. When the shaft is located within an opening, the positions of the support sections relative to each other are fixed, and the support surface will remain stable during use.

7 Claims, 2 Drawing Sheets

FIG. 3
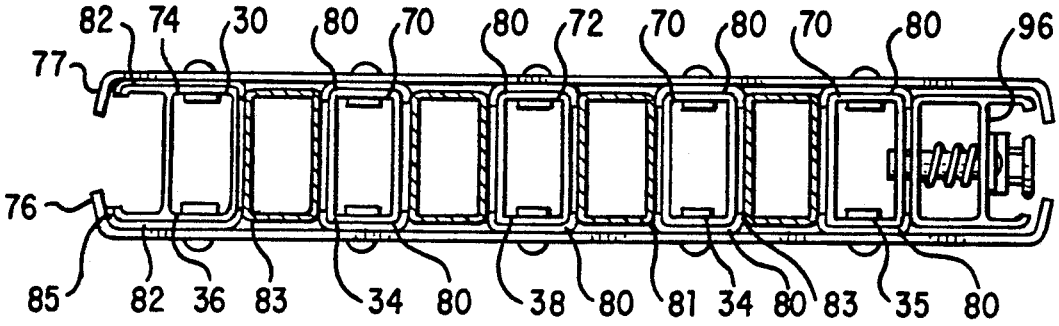
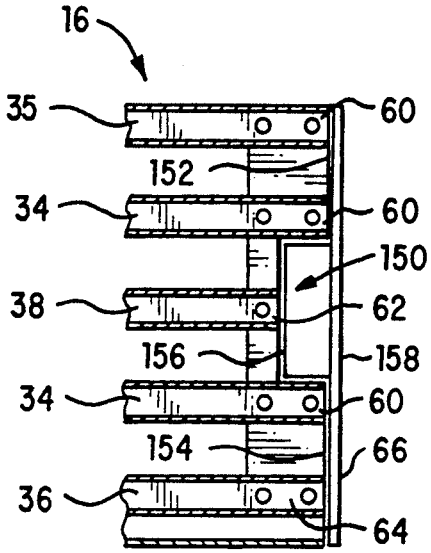
FIG. 4
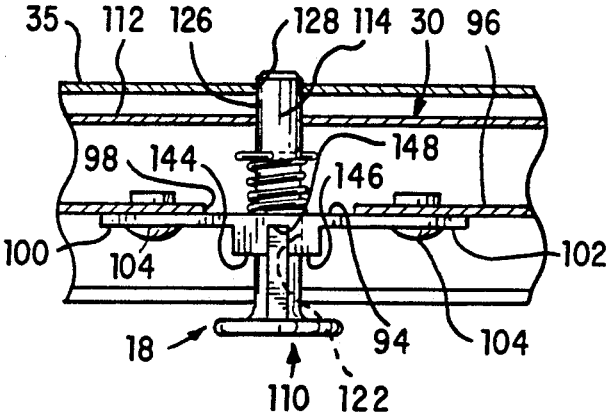
FIG. 5
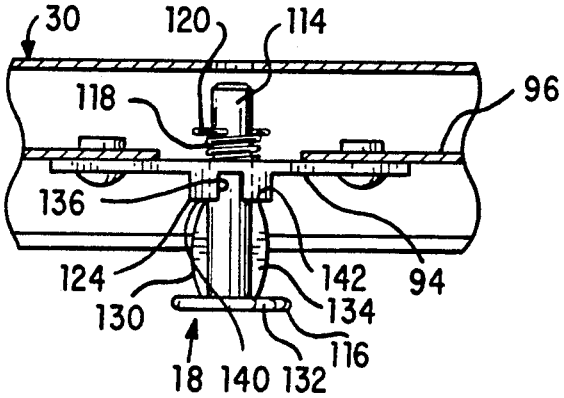
FIG. 6

EXTENDABLE SUPPORT

FIELD OF THE INVENTION

The present invention relates to supports and, more particularly, to an extendable support that can be locked in several extended positions.

BACKGROUND OF THE INVENTION

Supports, including scaffolding and planks, are used commonly to support maintenance personnel above a surface. For example, supports supported by step or trestle ladders are used on extension ladders while the sides are supported by ladder jacks are commonly used by siding and painting contractors.

The size of the support surface required, that is, the surface on which maintenance personnel can stand to perform maintenance, varies with circumstances. Accordingly, a support has been provided that can be adjusted to vary the size of its support surface. Specifically, the support is formed from two sections that are slidably engaged with each other. The sections can be slid together or apart to adjust the size of the support surface. However, the relative position of the support sections cannot be fixed, and the sections can slide with respect to each other during use.

Accordingly, there exists a need for an extendable support or plank the size of whose support surface can be fixed during use and positively locked in place. A friction locking extension plank by Ransara of Japan relies on friction to maintain the desired size of the extension plank.

SUMMARY OF THE INVENTION

The present invention provides a support including a support member defining a load-bearing support surface. The size of the support surface is adjustable. The support also includes a lock that releasably fixes the size of the support surface.

The present invention also provides a support including a pair of support sections movably engaged with each other. The support sections define a support surface. Movement of the support sections relative to each other causes adjustment to the size of the support surface. A lock is provided for releasably fixing the size of the support surface by releasably fixing the position of the support sections with respect to each other.

The present invention also provides a support including a pair of support sections movably secured to each other. The support sections define a support surface. Movement of the support sections relative to each other adjusts the size of the support surface. A locking member is provided on a first support section. The second support section defines openings spaced along the second support section that are adapted to receive the locking member when the support sections are so positioned with respect to each other that an opening confronts the locking member. The locking member fixes the size of the support surface when the locking member is positioned in an opening. Biasing apparatus is provided to bias the locking member toward a position in which an opening can receive the locking member when the support sections are appropriately positioned with respect to each other.

The present invention also provides a support including a pair of support sections movably engaged with each other. The support sections define a support surface. Movement of the support sections relative to each other causes adjustment of the size of the support surface. Apparatus is provided for releasably fixing the size of the support surface by releasably fixing the position of the support sections with respect to each other.

BRIEF DESCRIPTION OF THE DRAWINGS

In the accompanying drawings, the preferred embodiments of the invention and preferred methods of practicing the invention are illustrated in which:

FIG. 3 is an end sectional view of the support shown in FIG. 1, taken along the line III—III.

FIG. 4 is a sectional view of the support shown in FIG. 2, taken along the line IV—IV.

FIG. 5 is a view of a portion of the support shown in FIG. 1, showing the locking member.

FIG. 6 is a view of the lock shown in FIG. 5, showing the lock in the unlocked position.

DESCRIPTION OF THE PREFERRED EMBODIMENT

Figure 1:
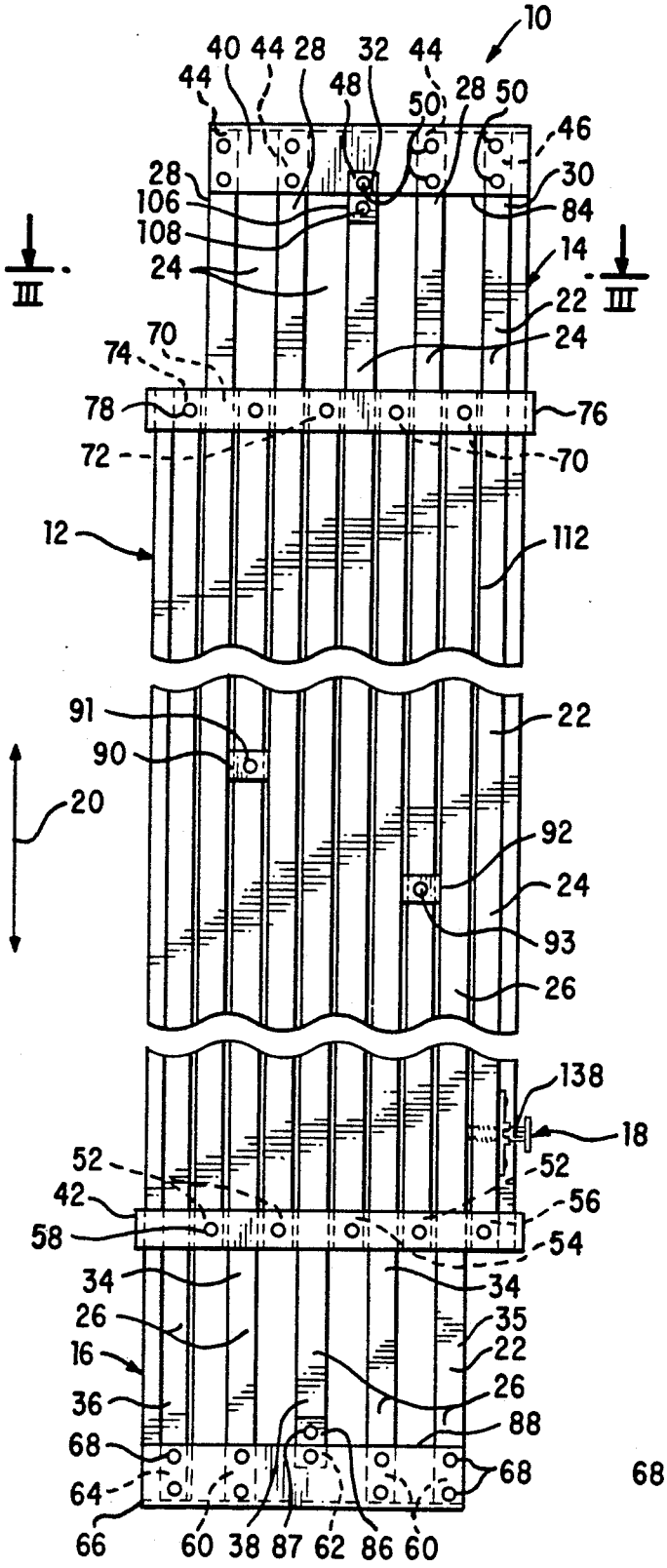
FIG. 1 is a top plan view of a support or plank provided by the present invention.

FIG. 1 shows a support 10, which includes a support member 12, consisting of a pair of support sections 14 and 16, and a lock 18. Sections 14 and 16 are secured together, but in a manner which permits them to be slid with respect to each other in the directions defined generally by arrows 20. Sliding sections 14 and 16 with respect to each other adjusts the width of support 10.

Support 10 defines a support surface 22, which consists of upper surface 24 of section 14 and upper surface 26 of section 16. As can be seen best in FIG. 1, the size of support surface 22 can be adjusted by sliding support sections 14 and 16 with respect to each other. Accordingly, support 10 can provide a support surface 22 with an adjustable size to permit adaptation of support 10 to applications requiring supports of various sizes.

A lock 18 is provided to fix sections 14 and 16 in a number of positions with respect to each other. Lock 18 can be released to adjust the relative position of section 14 with respect to section 16 to adjust the size of support surface 22.

Figure 2:
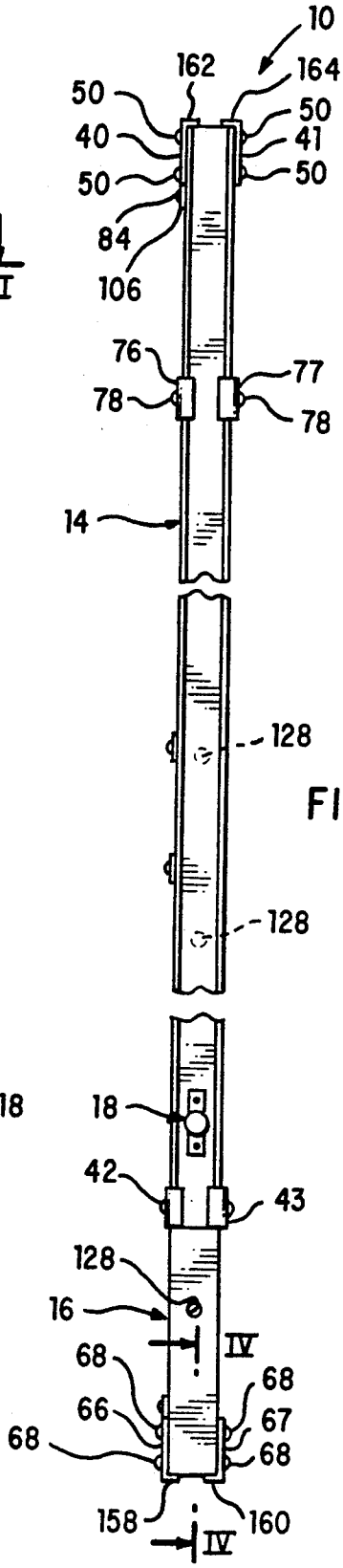
FIG. 2 is a side view of the support shown in FIG. 1.

Support section 14 includes decking members 28, flank decking member 30 and a shorter central decking member 32, the upper surfaces 24 of which define in part support surface 22. Similarly, support section 16 includes decking members 34, locking decking member 35, flank decking member 36, and a shorter central decking member 38. The upper surfaces 26 of decking members 34, 35, 36 and 38 define the remainder of support surface 22. Decking members 28, 30 and 32 of support section 14 are spaced from each other to permit decking members 34, 35, 36 and 38 of support section 16 to be interleaved with them as shown in FIG. 1. The spacing of the decking members permits longitudinal movement of the decking members of support section 14 with respect to the members of support section 16. The decking members can be fabricated in any known manner with suitable material. A number of indexes, or openings, 128 are formed in the side of decking member 35. Member 35 (see FIG. 2), which are adapted for engagement with the shaft of lock 18.

The relative positions of sections 14 and 16 with respect to each other are fixed when the shaft of lock 18 is in a locking position, that is, when the shaft is engaged in an opening 128. A support surface having one of a number of discrete sizes (corresponding to the number of openings 128 provided along the side of member 35) can be provided by disengaging the shaft of lock 18 from section 16, sliding support sections 14 and 16 relative to each other until the appropriate opening 128 is aligned with the shaft, and releasing lock 18 to permit the shaft to enter the selected opening 128. Lock 18 and its use are described in more detail below.

Decking members 34, 35, 36 and 38 of support section 16 are connected together at their ends by a pair of end angles or brackets 66 and 67 and a pair of crossbars 76 and 77, using rivets 68 and 78, and spacers 80. Specifically, ends 60 of decking members 34 and 35, end 62 of central of decking member 38, and end 64 of flank decking member 36 are secured to the underside of brackets 66 and 67 with rivets 68. Ends 70 of members 34 and 35, end 72 of central member 38, and end 74 of flank member 36 are secured to the undersides of crossbars 76 and 77 with rivets 78. Spacers 80, shown only for ends 70 and 72 in FIG. 3, are mounted between the ends of decking members 34, 35 and 38 and the undersurfaces of crossbars 76 and 77. Spacers 82, shown only for end 74, are mounted to the undersurfaces of crossbars 76 and 77 between flank member 36 and crossbars 76 and 77. Spacers 80 and 82 define guides 81, and 83 and 85, respectively, which cradle the ends of the decking members to help maintain them in place.

Ends 44 of decking members 28, end 48 of central member 32, and end 46 of flank member 30 are secured to the undersurfaces of brackets or end angles 40 and 41 with rivets 50. Ends 52 of members 28, end 54 of central member 32, and end 56 of flank member 30 are secured to the undersurfaces of crossbars 42 and 43 with rivets 58.

Additional 80 and 82 spacers (not shown) are mounted between the ends of decking members 28, 30, and 32, and brackets 40 and 41. Similarly, additional spacers 80 and 82 (not shown) are mounted between the ends of decking members 28, 30 and 32 and crossbars 42 and 43.

Stops are provided to limit the travel of support sections 14 and 16 with respect to each other. One stop 106 is mounted with a rivet 108 to end 48 of central decking member 32 adjacent the inboard edge 84 of bracket 40. Another stop 86 is mounted with a rivet 87 to end 62 of central decking member 38 adjacent edge 88 of bracket 66. A third stop 90 is mounted with a rivet 91 to the upper surface of a decking member 34 intermediate its ends. Finally, a stop 92 is mounted with a rivet 93 to the upper surface of a decking member 28.

Stops 106 and 86 engage crossbars 42 and 76 when support 10 is in its fully retracted position. Stops 90 and 92 engage crossbars 76 and 42, respectively, to limit the degree to which support 10 can be extended.

Lock 18 is provided to releasably lock support sections 14 and 16 in discrete positions with respect to each other to provide a number of discrete adjustments to the size of support surface 22. Lock 18 includes a bracket 94, which is mounted to web 96 of flank member 30 of support section 14. Web 96 defines a circular hole 98. Bracket 94 defines a pair of mounting plates 100 and 102 which are secured to either side of opening 98 with a pair of rivets 104.

Locking member 110 is mounted to bracket 94 and is adapted to pass through opening 114 formed in side 112 of decking member 30, to engage and lock in place decking member 35 and support section 16.

Locking member 110 includes a locking shaft 114, an actuator handle 116, a tension spring 118 and a snap ring 120. Shaft 114 is inserted through a cylindrical shaft 122 formed in a mounting 124 of bracket 94. Accordingly, a large portion of shaft 114 projects from bracket 94 toward decking members 30 and 35. In its most extended position, shaft 114 extends through circular opening 126 formed in member 30 and one of the openings 128 formed in decking member 35. Spring 118 is disposed around shaft 114 between mounting 124 and snap ring 120, which is mounted on shaft 114. Spring 118 exerts force on snap ring 120 to bias lock 18 toward its fully extended position. Actuator handle 116 defines a grip 132 and a pair of curved keys 130 and 134. Mounting 124 defines a pair of keyways 136 and 138. Keys 130 and 134 cooperate with mounting 124 to limit the travel of locking shaft 114, in both the extended and retracted positions, toward decking members 30 and 35. Specifically, keys 130 and 134 define stop surfaces 140 and 142, respectively. In the retracted position shown in FIG. 6, in which shaft 114 is not engaged with decking members 30 or 35, stop surfaces 140 and 142 are in contact with surfaces 144 and 146, respectively, of mounting 124. When locking member 110 is in its fully extended position, stop surfaces 140 and 142 are disposed within keyways 136 and 138, and stop surfaces 140 and 142 are in contact with surface 148 of mounting 124.

Each of sections 14 and 16 provides identical handle arrangements to facilitate sliding sections 14 and 16 with respect to each other. The handle arrangement for section 16 and bracket 66 is shown in FIG. 4. Lip 158 formed on bracket 66 functions as a handle. Similarly, lips 160, 162 and 164 formed on brackets 67 40 and 41 respectively, function as handles. As can be seen in FIG. 4, a handle guard 150 is mounted between ends 60, 62 and 64 of decking members 34, 35, 38, and 36, respectively, and brackets 66 and 67. Handle guard 150 extends as a continuous sheet between the undersurfaces of brackets 66 and 67. Handle guard 150 includes end sections 152 and 154. Section 152 is positioned and secured between end 60 of members 34 and 35 and bracket 66. Section 154 of guard 150 is positioned and secured between ends 60 and 64 of members 34 and 36, respectively, and brackets 66 and 67.

In use, support surface 22 of support 10 is adjusted by disengaging shaft 114 from opening 126 of member 30 and all openings 128 of member 35, and rotating actuator handle 116 until stop surfaces 140 and 142 confront surfaces 144 and 146 of mounting 124. Actuator handle 116 is released, and lock 18 assumes its retracted position, as shown in FIG. 6. Support sections 14 and 16 are slid with respect to each other to achieve the desired size of support surface 22 by gripping any of brackets 660, 67, 40 or 41 in the vicinity of guard section 156 of handle guard 150 and exerting force on support sections 14 or 16 in the appropriate direction shown by arrows 20. The positions of sections 14 and 16 are adjusted until an opening 128 confronts shaft 114 that, when engaged by shaft 114, will provide a support surface of the desired size. Grip 132 of actuator handle 116 is rotated until keys 130 and 134 become aligned with key ways 136 and 138. Grip 132 is released, keys 130 and 134 enter keyways 136 and 138, and stop surfaces 140 and 142 bear against surface 148 of mounting 124. Lock 18 then assumes its extended, or locking, position shown in FIG. 5. This process can be repeated to readjust the size of support surface 22.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A support comprising:

a pair of support section movably engaged with each other;

a support surface defined by said support sections, movement of said support sections relative to each other causing adjustment to the size of said support surface;

a lock for releasably fixing the size of said support surface by releasably fixing the position of said support sections with respect to each other, said lock is movable to a locked position and an unlocked position such that in the locked position, the lock fixes the support sections relative to each other and in the unlocked position, the lock allows the support sections to move relative to each other to adjust the size of said support surface; and means to releasably secure the lock in an unlocked position.

2. The support recited by claim 1 further comprising means for biasing said lock towards its said locked position.

3. A support as recited by claim 2 wherein the pair of support sections is a first support section and a second support section moveably engaged with each other and wherein the lock includes a mounting for attaching said lock to first support section, the second support section having openings spaced along said second support section adapted to receive said lock when said support sections are so positioned with respect to each other as to position at least one of said openings in a confronting relationship with said lock, said lock fixes the support sections relative to each other when said lock is positioned in said openings.

4. A support as described in claim 3 wherein the lock includes a shaft adapted to receive one of said openings.

5. A support as described in claim 4 wherein the biasing means comprises a spring for biasing said shaft towards a locked position.

6. A support as described in claim 5 wherein the means to releasably secure the lock includes a pair of keys disposed on and projecting from said shaft and a pair of keyways disposed on said mounting, said keyways support said keys when the shaft is pulled from said openings and rotated, said lock is secured in the unlocked position when said keys are supported by said keyways.

7. A support as described in claim 6 wherein the shaft includes a handle for grasping the shaft.

* * * * *

UNITED STATES PATENT AND TRADEMARK OFFICE

CERTIFICATE OF CORRECTION

PATENT NO. : 5,067,589

DATED : November 26, 1991

INVENTOR(S) : Frederick J. Bartnicki

It is certified that error appears in the above-identified patent and that said Letters Patent is hereby corrected as shown below:

Column 3, line 66, replace "114" with "126".

Column 4, line 15, delete "136 and";

Column 4, line 26, delete "136 and";

Column 4, line 63, delete "136 and";

Column 4, line 64, delete "136 and".

Column 5, line 12, replace "section" with -- sections -- .

Signed and Sealed this

Seventeenth Day of August, 1993

*Attest:*

Bruce Lehman

BRUCE LEHMAN

*Attesting Officer*

*Commissioner of Patents and Trademarks*